US005215239A

United States Patent [19]

Walters, Jr.

[11] Patent Number: 5,215,239

[45] Date of Patent: Jun. 1, 1993

[54] WEIGHT SUPPORT HARNESS

[76] Inventor: Paul A. Walters, Jr., 16 Lake Ovide Ct., Hampton, Va. 23669

[21] Appl. No.: 933,772

[22] Filed: Aug. 24, 1992

[51] Int. Cl.[5] ..... A45F 3/04

[52] U.S. Cl. ..... 224/259; 224/268; 224/910; 84/385 A

[58] Field of Search ..... 224/910, 259, 260, 258, 224/268, 209; 84/385 A, 327, 453

[56] References Cited

U.S. PATENT DOCUMENTS

| | | | |
|---|---|---|---|
| 741,098 | 10/1903 | Bibler | 224/260 |
| 2,149,803 | 3/1939 | Wight . | |
| 2,656,875 | 10/1953 | Hutchinson . | |
| 3,021,744 | 2/1962 | Kester . | |
| 3,129,863 | 4/1964 | Haugen . | |
| 3,346,154 | 10/1967 | Bishop . | |
| 3,583,600 | 6/1971 | Scott | 224/209 |
| 4,226,161 | 10/1980 | Goetsch . | |
| 4,252,016 | 2/1981 | O'Rafferty . | |
| 4,254,901 | 3/1981 | McIntosh . | |
| 4,280,645 | 7/1981 | Goodden . | |
| 4,630,763 | 12/1986 | Friedman . | |
| 4,802,613 | 2/1989 | Tierney . | |

FOREIGN PATENT DOCUMENTS

| | | | |
|---|---|---|---|
| 667935 | 11/1988 | Switzerland | 84/385 A |

*Primary Examiner*—Linda J. Sholl

*Attorney, Agent, or Firm*—Wallace J. Nelson

[57] ABSTRACT

A weight support harness, including separate portions disposed over each of the shoulders and beneath the arms of a musician, terminates in a pair of hooks at the front of the musician for supporting a saxophone or similar instrument. The harness is adjustable to comfortably accommodate right or left handed, as well as male or female, musicians. Either of the pair of hooks is capable of supporting the instrument weight to permit transferring the instrument from the front position to a side position during breaks or between musical sessions. A separate adjustable strap is connected to each of the harness portions and extends across the back shoulders of the musician to distribute some of the instrument support to the musician's back. In one embodiment, supplemental straps are employed to reduce strap contact with a female musician's breasts.

8 Claims, 2 Drawing Sheets

WEIGHT SUPPORT HARNESS

FIELD OF THE INVENTION

This invention relates generally to a weight support harness and relates specifically to an improved shoulder harness to reduce neck strain on a musician during a musical instrument performance.

BACKGROUND OF THE INVENTION

Most musical instruments, while being played, are presently supported by a strap disposed about the neck of the musician. A number of musical instruments, and in particularly saxophones, are relatively heavy and during extended musical sessions, marching band use, and the like, neck strap supports put tremendous strain on the musicians. To alleviate this stain, some prior art systems have utilized shoulder strap supports alone, or shoulder straps in combination with neck straps. Although an improvement over neck straps alone, these prior art systems are limited in performance and do not provide the versatility of the present invention.

It is an object of the present invention to provide a novel adjustable shoulder strap arrangement to support a weight in front of an individual.

Another object of the present invention is an adjustable shoulder harness for supporting a musical instrument in position to be played by either a left-handed or right-handed individual.

An additional object of the present invention is an adjustable shoulder harness for supporting a musical instrument in a comfortable position for both male and female musicians.

A further object of the present invention is an adjustable shoulder harness for a musical instrument that will selectively support the weight of the instrument in front of the individual during use and at the side of the individual during rest or between performances.

Another object of the present invention is an adjustable shoulder harness for a musical instrument that evenly distributes the instrument weight across the shoulders and back of the instrument user.

SUMMARY OF THE INVENTION

According to the present invention the foregoing and additional objects are attained by providing a pair of continuous lengths of belt material each divided into first and second loops by a sliding adjustment buckle and wherein each first loop is positioned over a respective arm of the individual so as to extend over the shoulders and beneath the arms. The second loops are each provided with an eye-ring having an integral hook thereon and adapted to connect to a common point on a musical instrument or other weighted object. An adjustable length of belt material is secured to the first loop of each member of the pair of continuous lengths of belt material and adapted to extend across the back when the first loops are disposed over the arms of the individual.

The respective sliding adjustment buckles on the pair of continuous lengths of belt material permit adjustment of the first and second loop lengths for vertical adjustment of the position of the respective hooks relative to the individual and thereby permit the hooks to be disposed at the same or different heights.

In one embodiment of the invention, a separate additional length of belt material is adjustably attached to each first loop for releasable attachment to a waist belt to permit pulling of the portions of each first loop passing beneath the arms of the individual toward the waist belt.

BRIEF DESCRIPTION OF THE DRAWINGS

A more complete appreciation of the invention and many of the attendant advantages thereof will be more readily apparent as the same becomes better understood with reference to the accompanying drawings wherein.

DETAILED DESCRIPTION

Figure 1:
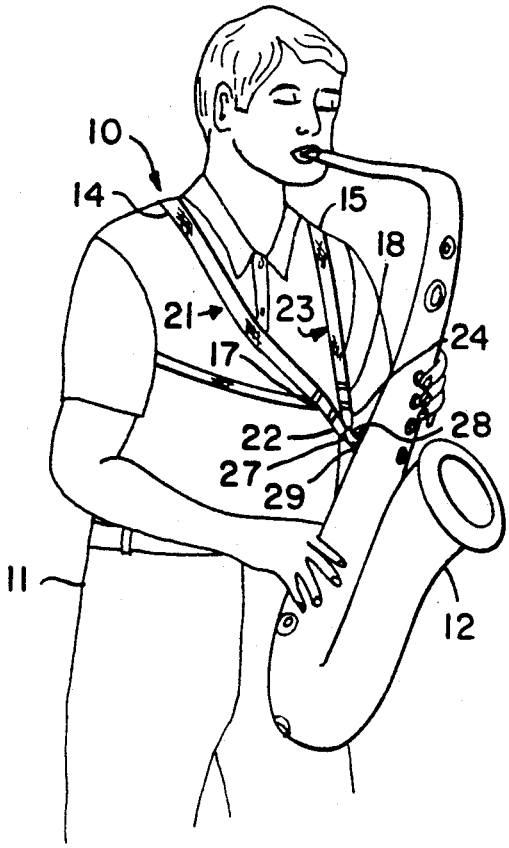
FIG. 1 is a part schematic view of the weight support harness of the present invention as employed to support a saxophone by a musician.
Figure 2:
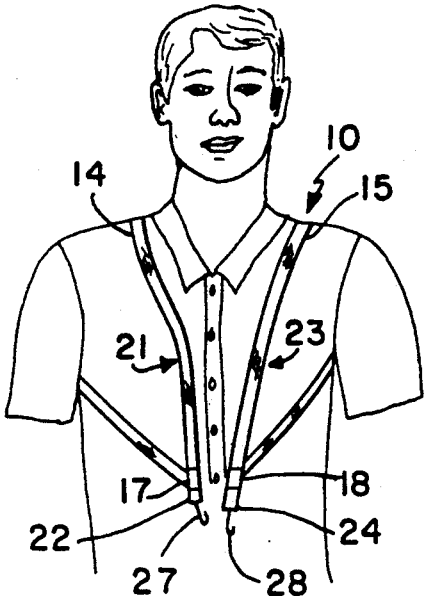
FIG. 2 is a front view of the weight support harness positioned on a musician shown in FIG. 1, sans saxophone.

Referring now to the drawings, and more particularly to FIGS. 1 and 2, the weight support harness of the present invention is shown, and designated generally by reference numeral 10, as employed by a musician 11 to support the weight of musical instrument 12.

Weight support harness 10 includes a pair of continuous lengths of belt material, designated by reference numerals 14,15 and disposed, one each, over the respective arms so as to rest on the shoulder and extend beneath the arms of the individual. A sliding adjustment buckle is disposed on each of the continuous lengths 14,15 as designated, respectively, by reference numerals 17,18 and the details of which will be further described hereinafter.

Each of the continuous lengths of belt material 14,15 are divided into first and second loops by the respective sliding adjustment buckles 17,18. The first and second loops for belt material length 14 are designated, respectively, by reference numerals 21,22 while the first and second loops on belt material length 15 are designated, respectively, by reference numerals 23,24.

A pair of weight engagement hooks 27,28 extend from respective second loops 22,24 and serve to engage a common ring or grommet 29 disposed on instrument 12 for support thereof by harness 10.

Figure 3:
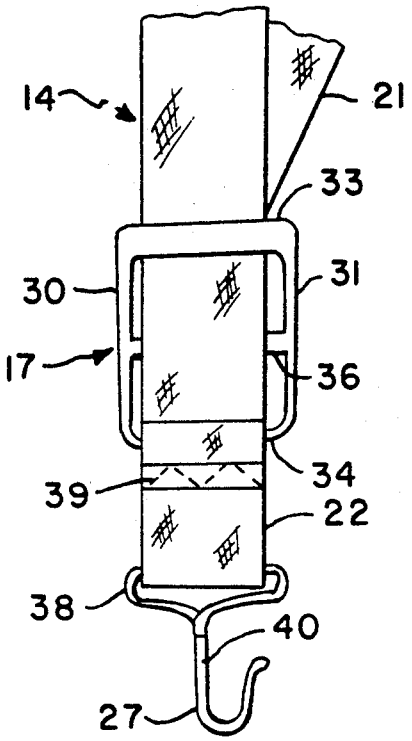
FIG. 3 is an enlarged view of one of the adjustment buckles and associated hook structure for the weight support harness shown FIGS. 1 and 2.

Referring now more particularly to FIG. 3, the details of one sliding adjustment buckle 17 and weight engagement hook 27 will now be described. It is to be understood that the structure of the other sliding adjustment buckle 18, weight engagement hook 28, and continuous length of material 15 are all identical to that described for buckle 17, hook 27 and material length 14 and the description thereof is omitted only in the interest of brevity. As shown, buckle 17 includes a pair of spaced elongated frame members 30 and 31, with first and second transverse ends 33,34 and a transverse divider bar 36 all being integral with frame members 30,31.

The continuous length of material 14 is formed from a single length of belt material having the ends thereof placed together and threaded under transverse end 33 of buckle 17, over divider bar 36, under transverse end 34, through an eye-ring 38 (integral with hook 27), and then doubled back with one of the material ends being wrapped around transverse end 34 of buckle 17 and secured by stitching 39 to the other end of the material to form continuous length 14. The continuous length of material 14 is thus divided into a single strand first loop 21 section and a double strand second loop section 22. Buckle 17 permits adjustment of the respective lengths of loops 21 and 22, while buckle 18 permits adjustment of the respective lengths of loops 23 and 24, to aid in positioning musical instrument 12 relative to the musician 11.

Referring back to FIGS. 1 and 2, when buckle 17 is moved upward, or away from hook 27 to shorten the length of loop 21 and lengthen loop 22, loop 21 serves to maintain harness 10 closer to the torso of musician 11 and restrict movement of instrument 12 (toward the left of musician 11 as seen in the drawings). If buckle 18 is not moved upward, loop 23 remains in the extended position shown and the musician 11 may "swing" instrument 12 toward his right shoulder. Movement of buckle 18 upward, while leaving buckle 17 and loop 21 in the extended position shown, would permit more swinging movement of instrument 12 toward the musician's left and restrict movement thereof toward the right. Obviously, either or both buckles 17 and 18 may be adjusted at the desire of the musician for comfort and preferred maneuverability.

Weight engagement hook 27 is provided with a protective coating 40, formed of suitable plastic or rubber, and serving to prevent or reduce scarring or scratching of instrument 12 by hook 27.

Figure 4:
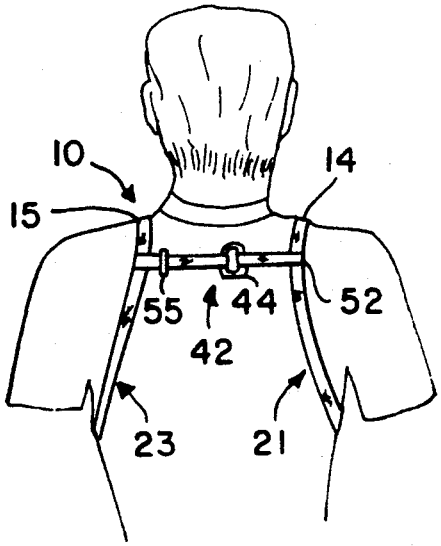
FIG. 4 is a rear view of the weight support harness shown in FIGS. 1 and 2.
Figure 5:
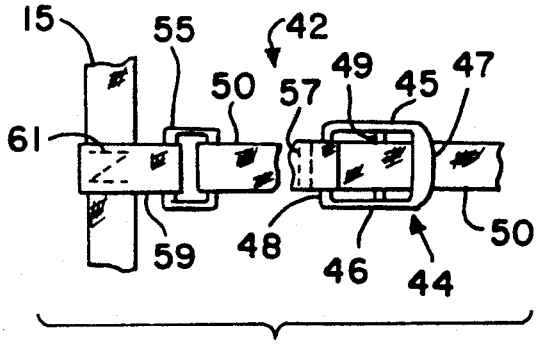
FIG. 5 is an enlarged view of the adjustable back support portion of the weight support harness shown in FIG. 4.

Referring now more particularly to FIGS. 4 and 5, an adjustable link 42 is secured to the first loops 21,23 of respective continuous lengths of material 14,15 and extends across the back of the musician when first loops 21,23 are disposed about the arms of the musician. Adjustable link 42 includes a slidable adjustment buckle 44 (FIG. 5). Buckle 44 is provided with a pair of spaced elongated frame members 45,46 having integral first and second transverse ends 47,48 and an integral transverse divider bar 49. A length of belt material 50 has one end thereof stitched or otherwise secured to continuous length of material 14, as designated by reference numeral 52 (FIG. 4).

The other end of belt length 50 is threaded through buckle 44 by passing under transverse end 47, over transverse divider bar 49 and under transverse end 48. This end of belt length 50 is then passed through an eye-ring 55, doubled back and wrapped around transverse end 48 of buckle 44 and fastened thereto by being stitched to itself, as designated by reference numeral 57.

A short length of belt material 59 is also threaded through eye-ring 55 and has both ends thereof stitched, or otherwise conventionally fastened to continuous belt length 15, as designated by reference numeral 61. The loop formed by the short length of belt material 59 maintains eye-ring 55 fixed adjacent belt length 15. Sliding movement of adjustment buckle 44 increases or decreases the length of the loop in belt length 50, formed between buckle 44 and eye-ring 55, to thereby adjust the effective length of link 42, and adapt harness 10 to the physical build of the musician.

Figure 6:
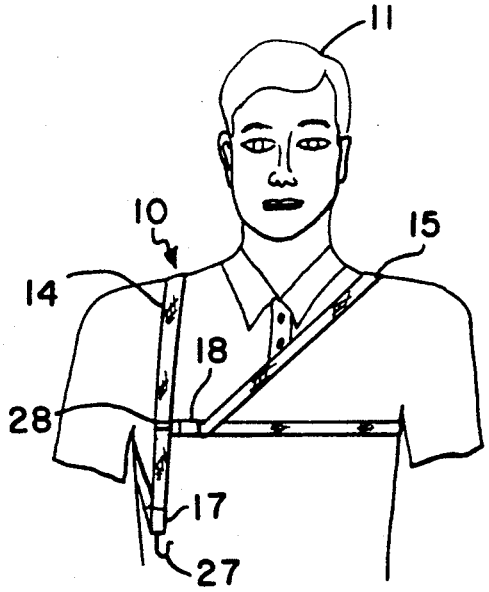
FIG. 6 illustrates one position of the weight support harness of the present position when employed to support a musical instrument while the musician is at rest or between music sessions.

Referring now to FIG. 6, weight support harness 10 is illustrated in position to permit the musician to move the instrument to one side or essentially under his arm during a break between music sessions. Either of hooks 27 or 28 and the attached harness is capable of supporting the entire weight of instrument 12 (not shown in this FIG for purposes of clarity).

By disengaging hook 28 from instrument 12 the instrument may be easily shifted, to be suspended by the remaining hook 27, to a comfortable position beneath the arm of the musician. The unattached hook 28 is then hooked over the continuous belt length 14 to maintain that portion of harness 10 out of the way. This arrangement permits the musician to relax between sessions without having to worry about laying his instrument down or placing it in a carrying case. Obviously, the position of hooks 27,28 could be reversed if the musician desired to support his instrument under his left arm during a break. Also, if the musician desires to place the instrument in its case, or to lay the instrument down between musical sessions, harness 10 need not be removed but may be comfortably retained on by connecting hooks 27 and 28 to each other.

Figure 7:
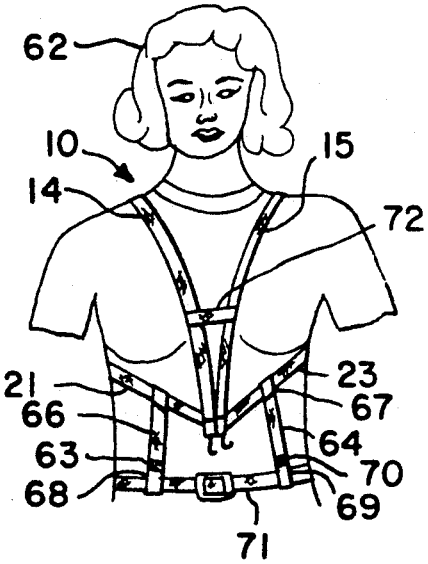
FIG. 7 is a part schematic view of a slight modification of the weight support harness shown in FIGS. 1 and 2 and adapted for comfortable use by a female musician.
Figure 8:
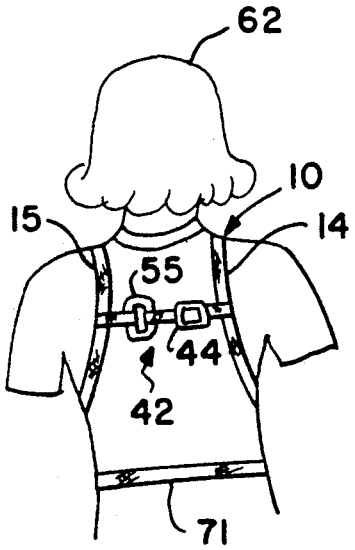
FIG. 8 is a rear view of the weight support harness shown in FIG. 7.

Referring now to FIGS. 7 and 8, a slight modification of the invention adapted to accommodate female musicians will now be described. The weight of a musical instrument bearing against the breast of a female musician for extended periods of time can become very uncomfortable, particularly to full figured individuals. To alleviate this, adjustable supplemental straps 63,64 are added to weight support harness 10. The remaining parts of harness 10 are identical to that described hereinbefore and the description thereof is not repeated here in the interest of brevity.

In the embodiment illustrated in FIGS. 7 and 8, straps 63,64 are provided with a loop at one end thereof as designated, respectively, by reference numerals 66,67. Loops 66,67 are slidably received by the portions of first loops 21,23 of respective continuous lengths of belt material 14,15 extending beneath the arm of musician 62. The free ends of straps 63 and 64, designated respectively by reference numerals 68 and 69, are provided with a conventional self-adhering, hook and loop type, fastening surface 70. Fastening surfaces of this type are commercially available under the trade name, Velcro. In use, loops 66,67 are slidably moved along the lengths of first loops 21,23 to the position desired and free ends 63,64 are extended around waist belt 71 worn by musician 62. Sufficient downward force is applied to straps 68,69 to pull the portion of first loops 21,23 that pass beneath the arms completely below the breasts of musician 62. Each free end 68 and 69 of straps 63 and 64 is then Velcro fastened to itself to retain first loops 21,23 in position. When not in use, straps 63,64 remain suspended by first loops 21,23 and hang harmless out of the way.

In lieu of the Velcro fastening for free ends 68 and 69 of straps 63 and 64, suitable snap fasteners, adjustable buckles, and the like, may be employed. Also, when a waist belt 71 is not worn by musician 62, straps 63,64 may be secured to other portions of the musician's clothing.

An optional additional strap 72 may also be added to harness 10, when so desired. Strap 72, as shown, is a single length of belt material provided with a coating of Velcro or similar fastening surface on a portion of each end thereof and adapted to extend around the portion of loops 21,23 that extend over the shoulder of musician 62. Strap 72 is employed to adjust the distance between this portion of loops 21,23 to permit the musician to position and maintain loops 21,23 between the breasts, or at a desired more comfortable location.

No specific materials have been discussed for constructing harness 10, it being understood that any material having the necessary strength and durability requirements for the purpose intended may be employed in practice of the present invention. In the illustrated preferred embodiments, the belt material employed was one-half inch nylon webbing. Different widths of this, and other materials such as thin leather strips, woven cloth, and the like, may also be employed without departing from the spirit and scope of the invention.

Other variations and modifications of the invention will be readily apparent to those skilled in the art in the light of the above teachings.

Thus, although the invention has been described relative to specific embodiments thereof, it is not so limited and there are numerous variations and modification of the present invention that will be readily apparent to those skilled in the art without departing from the spirit and scope of the appended claims. It is therefore to be understood that, within the scope of the appended claims, the invention may be practiced other than as specifically described herein.

What is claimed as new and desired to be secured by Letters Patent of the United States is:

1. A harness for assisting an individual in releasably supporting a weighted object, comprising:

a pair of continuous lengths of belt material adapted to be disposed, one each, over the respective arms, and to rest on the shoulder and extend beneath the respective arms, of the individual;

a sliding adjustment buckle disposed on each member of said pair of continuous lengths of belt material;

each said sliding adjustment buckle having a pair of spaced elongated frame members provided with integral first and second transverse ends and an integral transverse divider bar spaced from said first and said second transverse ends;

each member of said pair of continuous lengths of belt material being formed of a single length of belt material having the ends thereof secured together after extending under said first end of one said sliding adjustment buckle, over said intermediate transverse divider bar, under said second transverse end, doubled back and attached to each other and to said second end of said sliding adjustment buckle so as to form first and second loops of belt material extending from said respective first and second ends of said sliding adjustment buckle;

an eye-ring having an integral hook thereon slidably retained on each said second loop of belt material;

each said integral hook adapted to engage a common point of a weighted object; and an adjustable length of belt material secured to said first loop of each member of said pair of continuous lengths of belt material and adapted to extend across the back of an individual when said first loops are disposed over the arms of the individual and thereby provide individual back support for the weight of a weighted object attached to said hooks.

2. The harness of claim 1 wherein said belt material is selected from the group of belt materials consisting of nylon webbing and thin leather, and wherein said sliding adjustment buckles permit adjusting the length of said first and second loops of belt material.

3. The harness of claim 1 wherein said adjustable length of belt material is provided with a third sliding adjustment buckle, said third sliding adjustment buckle having a pair of spaced elongated frame members, integral first and second transverse ends and an integral transverse divider bar spaced from said first and said second transverse ends; said adjustable length of belt material having a first end secured directly to a portion of one of said first loops of belt material adapted to rest on the shoulder of the individual and a second end extending under each transverse end and over said integral transverse divider bar of said third sliding adjustment buckle, through an eye-ring and connected to said second transverse end of said third sliding adjustment buckle; a short length of belting material secured to the other of said first loops of belt material adapted to rest on the other shoulder of the individual; said short length of belting material forming a closed short loop receiving and retaining said eye-ring.

4. The harness of claim 1 wherein each of said first loops of belt material includes a first portion disposed over the shoulder of the individual and a second portion extending beneath an arm of the individual; means disposed on said second portion of each of said first loops of belt material for biasing said second portion of each said first loop away from said first portion of said first loops extending over the shoulder of the individual.

5. The harness of claim 4 wherein said means disposed on said second portion of each of said first loops includes a separate length of belt material, each said separate length of belt material having a first end forming a closed loop slidably positioned on one of said second portions of each said first loop of belt material and a second free end, said second free end being provided with a self adhering hook and loop connecting surface over at least a portion thereof, a waist belt positioned around the waist of the individual and each said second free end being disposed about said waist belt and attached to itself to retain said second portions of said first loops extending beneath the respective arms of the individual spaced from said first portions of said first loops extending over the shoulder of the individual.

6. The harness of claim 5 including an adjustment strap secured to each of said first loops and serving to permit adjustment of the distance between said first portions of said first loops when said harness is disposed on an individual.

7. A harness for providing shoulder support and preventing neck strain on a musician while performing on a harness supported musical instrument, comprising:

a pair of continuous length belts;

a sliding adjustment buckle disposed on each of said pair of continuous length belts;

each said sliding adjustment buckle having a pair of spaced elongated frame members provided with integral first and second transverse ends and an integral transverse divider bar spaced from said first and said second transverse ends;

each member of said pair of continuous length belts being formed of a single length of belt material having the ends thereof secured together after extending under said first transverse end of one said sliding adjustment buckles; over said intermediate transverse divider bar, under said second transverse end and doubled back and attached to each other and to said second end of said sliding adjustment buckle so as to form first and second loops of belt material extending from said respective first and second ends of said sliding adjustment buckle;

an eye-ring having an integral hook disposed thereon slidably retained on each said second loop of belt material;

each said integral hook adapted to engage a common point on a musical instrument; and, each said first loop of belt material adapted to be disposed over separate arms of a musician to provide a first portion thereof resting on the shoulder of the musician and a second portion thereof extending beneath the arm of the musician.

8. The harness of claim 7 including an adjustable length of belt material secured to said first portion of each said first loop and adapted to extend across the back of the musician when said first loops are disposed over the arms of the musician.

* * * * *